US006042339A

United States Patent [19]

Blateri et al.

[11] Patent Number: 6,042,339

[45] Date of Patent: Mar. 28, 2000

[54] CEILING FAN ASSEMBLY AND METHOD FOR ASSEMBLING SAME

[75] Inventors: Frank Blateri, Coppell, Tex.; Wang Liang Chou, Taichung, Taiwan

[73] Assignee: Aloha Housewares Co., Ltd., Taiwan

[21] Appl. No.: 09/097,623

[22] Filed: Jun. 16, 1998

[51] Int. Cl.[7] ..... F04D 29/34

[52] U.S. Cl. ..... 416/219 A; 416/5; 416/210 R; 416/220 A; 416/207

[58] Field of Search ..... 416/5, 210 R, 416/204 R, 219 A, 220 A, 221, 205, 206, 207

[56] References Cited

U.S. PATENT DOCUMENTS

| | | | |
|---|---|---|---|
| 3,073,395 | 1/1963 | Duncan | 416/220 A |
| 4,511,310 | 4/1985 | Pearce | 416/5 |
| 4,746,271 | 5/1988 | Wright . | |
| 4,850,799 | 7/1989 | Bucher, Sr. et al. | 416/5 |
| 5,304,037 | 4/1994 | Scofield | 416/5 |
| 5,354,177 | 10/1994 | Chang | 416/220 A |
| 5,372,480 | 12/1994 | Van Meter et al. | 416/220 A |
| 5,458,463 | 10/1995 | Chiang | 416/5 |
| 5,486,094 | 1/1996 | Davis, Jr. | 416/5 |
| 5,542,819 | 8/1996 | Bucher et al. | 416/210 R |

*Primary Examiner*—Edward K. Look
*Assistant Examiner*—Richard Woo
*Attorney, Agent, or Firm*—Haynes & Boone, L.L.P.

[57] ABSTRACT

A ceiling fan assembly and method for assembling same in which a fan blade is placed over an arm having a post that extends in an opening in the blade. A fastener is attached to the post to secure the blade to the arm, and a flange on the arm is inserted in a slot in the rotor of the fan motor to retain the arm, and therefore, the blade, relative to the rotor.

20 Claims, 3 Drawing Sheets

CEILING FAN ASSEMBLY AND METHOD FOR ASSEMBLING SAME

BACKGROUND OF THE INVENTION

The present invention relates to a ceiling fan assembly and a method for assembling same, and, more particularly, to such an assembly and method in which the fan assembly can be assembled relatively easily and quickly using a minimum number of parts.

Rotating fans that are mounted to the ceilings of homes and businesses are very popular. These types of fans consist of a plurality of angularly-paced blades and a plurality of arms that connect the blades to the rotor portion of an electric motor mounted in a housing. Since the blades, arms and the motor are all manufactured and shipper separately, they must be assembled and mounted at the site. However, this assembly and mounting is relatively difficult and time-consuming since each blade is attached to its arm by a plurality of fasteners, and each arm is attached to the rotor end casing by a plurality of fasteners. Since there are usually five blades and arms, the labor costs involved in assembling and mounting the complete fan assembly constitutes a very high percentage of the overall cost of the assembly.

Therefore, what is needed is as fan assembly and a method of assembling same in which the fan blades can be easily and quickly attached to the arms, and the arms can be easily and quickly attached to the motor; thus considerably reducing the labor costs in assembling and mounting the fan assembly.

SUMMARY OF THE INVENTION

The present invention, accordingly, is directed to a ceiling fan assembly and method for assembling same in which a fan blade is placed over an arm having a post that extends in an opening in the blade. A fastener is attached to the post to secure the blade to the arm, and a flange on the arm is inserted in a slot in the rotor of the fan motor to retain the arm relative to the rotor.

Several advantages result from the assembly and the method of the present invention. For example, the use of a plurality of nuts, bolts and screws is eliminated and the blades can be connected to the arms, and the arms to the rotor, using a minimum of fasteners. As a result, the fan assembly can be assembled and mounted relatively easily and quickly thus considerably reducing the labor costs.

DESCRIPTION OF THE PREFERRED EMBODIMENT

Figure 1:
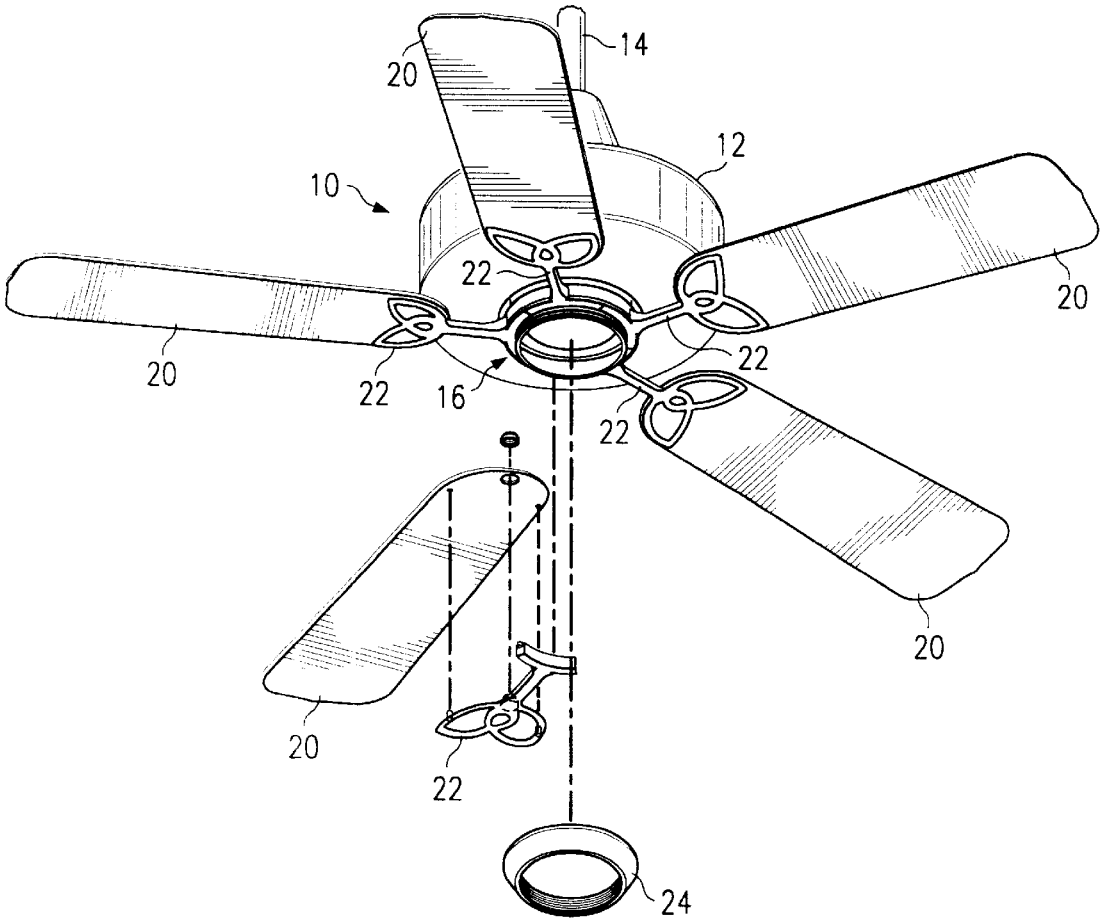
FIG. 1 is an isometric, exploded view of the fan assembly of the present invention.

FIG. 1 of the drawings depicts the fan assembly of the present invention which is referred to, in general, by the reference numeral 10 and which consists of a housing 12 connected to a ceiling of a building by a mounting rod 14. It is understood that the mounting rod 14 is connected to the ceiling in any known manner, and that electrical conductors extend from an electrical box (not shown) mounted to the ceiling, through the rod, and into the interior of the housing 12. A conventional electrical motor is provided in the housing 12 that includes a stator (not shown) and a rotor that includes an end casing 16 that protrudes slightly from the lower surface of the housing, as viewed in FIG. 1. Five elongated blades 20 are mounted to the rotor end casing 16 by five mounting arms 22, respectively, and an internally threaded retainer ring 24 threadedly engages the casing and retains the arms in the casing, all in a manner to be described.

Figure 2:
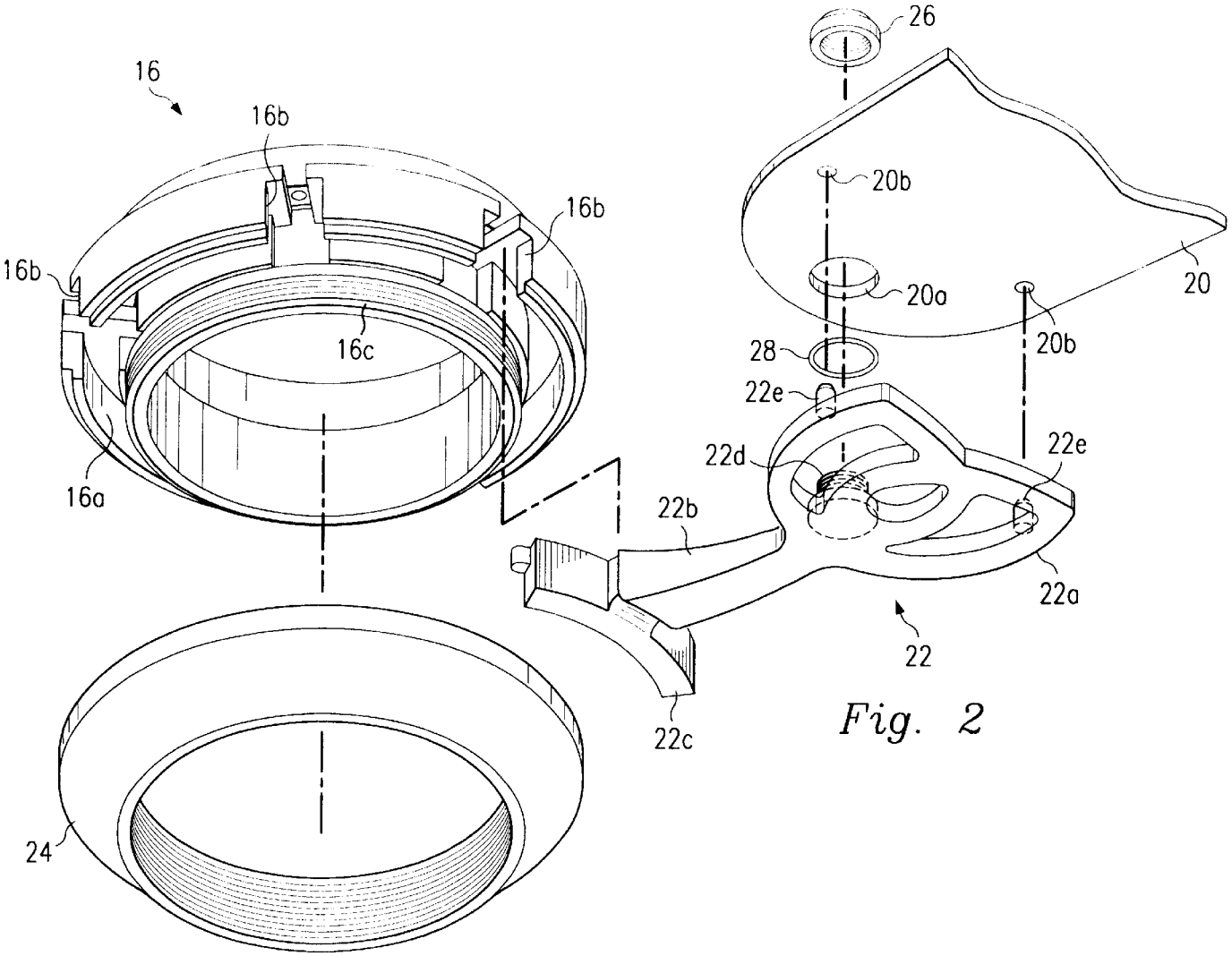
FIG. 2 is an enlarged, isometric, exploded view of a portion of the fan assembly of FIG. 1.

The details involving the connection of a blade 20 to its corresponding arm 22, and the connection of the latter arm to the rotor end casing 16 are better shown in FIG. 2. More particularly, the arm 22 includes a relatively wide mounting portion 22*a* that has openings extending therethrough to reduce its weight, a necked-down portion 22*b* one end of which extends from the portion 22*a*, and an arcuate flange 22*c* extending from the other end of the portion 22*b* and extending generally perpendicular thereto. A threaded post 22*d* and two guide pins 22*e* all extend from the upper surface of the arm portion 22*a*. Preferably, the arm portions 22*a*, 22*b*, and 22*c*, as well as the post 22*d* and the guide pins 22*e* are all molded integrally.

The corresponding end of the blade 20 has an enlarged opening 20*a* extending therethrough for receiving the post 22*d*, and two other openings 20*b* for receiving the two guide pins 22*e*, respectively. An internally threaded cap 26 is provided which engages the post 22*d* to retain the blade 20 to the arm 22, and a seal ring 28 extends between the lower surface of the post 22*d* and the inner wall of the blade 20 defining the opening 20*a*.

An annular slot 16*a* is defined in the rotor end casing 16 which receives the flange 22*c* of the arm 22 shown in FIG. 2 and the flanges of the other arms. Five angularly-spaced, axially-extending slots 16*b* are also formed in the rotor end casing 16 which respectively receive the necked-down portion 22*b* of the arm 22 shown in FIG. 2, and the necked-down portions of the other arms 22, in a friction fit. The rotor casing 16 also has an externally threaded cylindrical member 16*c* disposed immediately adjacent the slot 16*a* which is adapted for threaded engagement by the retainer ring 24 so that the ring can be threadedly connected to the member 16*c* and thus function to retain the flange 22*c*, and the flanges of the other arms 22, in the slot 16*a*.

Figure 3:
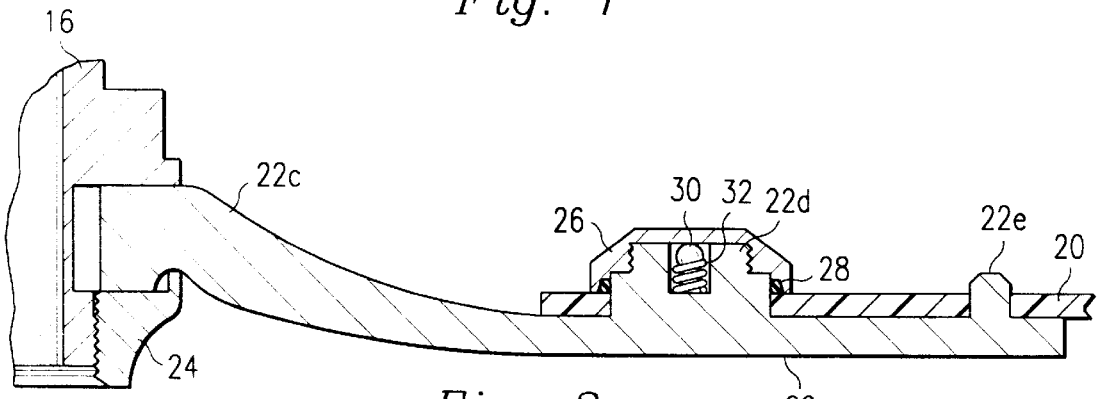
FIG. 3 is a sectional view of a portion of the fan assembly of FIGS. 1 and 2.

As shown in FIG. 3, a counter bore is provided in the post 22*d* of the arm 22 which receives a ball 30, and a spring 32 extends between the ball and the bottom of the counter bore to urge the ball upwardly, as viewed in FIG. 3. FIG. 3 also depicts the blade 20 of FIG. 2 mounted on the arm 22, and the latter arm mounted in the rotor end casing 16. In this mounted position, the post 22*d* and the guide pins 22*e* of the arm 22 extend through the openings 20*a* and 20*b*, respectively, of the blade 20. Also, the cap 26 is in threaded engagement with the post 22*d*, and the ball 30 is urged upwardly against the inner upper surface of the cap 26 to tighten the threaded connection between the cap and the post. Also, the flange 22*c* of the arm 22 extends in the slot 16*a* of the rotor end casing 16, and the retainer ring 24 is in threaded engagement with the cylindrical member 16*c* of the casing to secure the arm 22 relative to the casing. It is understood that the other arms 22 and blades 20 shown in FIG. 1 are identical to the arm and blade shown in FIG. 2 and are connected together and mounted to the rotor end casing 16 in the same manner.

To mount the ceiling fan 10 to a ceiling, the rod 14 (FIG. 1) is connected to the ceiling in any known manner, and the housing 12 is connected to the rod with the lower portion of the rotor end casing 16 protruding slightly from the lower end of the housing 12 as shown in FIG. 1. The blades 20 are connected to the arms 22 by inserting the post 22*d* of each arm in the opening 20*a* of each blade, and inserting the guide pins 22*e* of each arm in the openings 20*b*, respectively, of each blade to align each blade relative to its corresponding arm. The cap 26 is then threaded over the post 22*d* to secure the blade 20 to the arm. Each arm 22, with its corresponding blade 20 attached thereto is then lifted up so that its flange 22*c* extends in a portion of the slot 16*a* and the arm portion 22*b* extends in its corresponding slot 16*b* in a friction fit, with the weight of the blade establishing a fulcrum that urges the flange into the slot. The retainer ring 24 is then threaded over the cylindrical portion 16*c* of the rotor end housing and the assembly is complete. As a result the fan assembly 10 is assembled and mounted in a very easy and quick manner utilizing a minimum of parts and effort.

Figure 4:
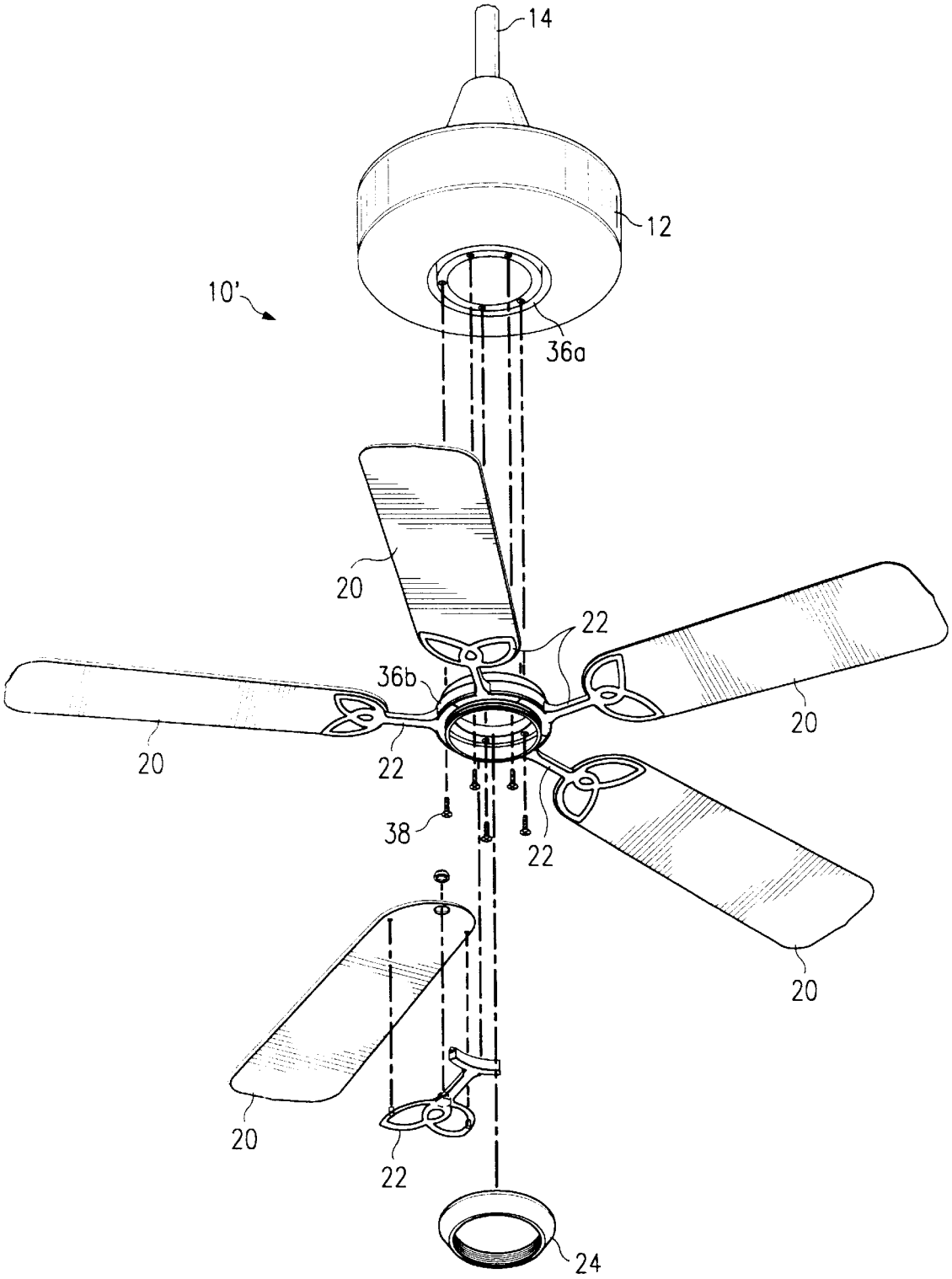
FIG. 4 is an isometric, exploded view of an alternate embodiment of the fan assembly of the present invention.

The embodiment of FIG. 4 is very similar to that of FIGS. 1–3 and includes many of the same components of the latter embodiment, which are given the same reference numerals. According to the embodiment of FIG. 4, a fan assembly 10' is provided that includes an upper rotor end casing portion 36*a* and a lower rotor end casing portion 36*b*. The upper casing portion 36*a* is mounted in the housing 12 with its lower end exposed via an opening in the housing; and the lower casing portion 36*b* contains an annular flange, five angularly-spaced slots, and an externally threaded cylindrical portion identical to the annular flange 16*a*, the angularly-spaced slots 16*b*, and the externally threaded cylindrical portion 16*c* of the embodiment of FIGS. 1–3. The lower casing portion 36*b* is bolted to the upper casing portion 36*a* by a plurality of bolts 38 that extend through aligned openings in the casing portions 36*a* and 36*b*. Otherwise the embodiment of FIG. 4 is identical to that of FIGS. 1–3.

It is understood that variations may be made in the foregoing without departing from the scope of the invention. For example the number of blades 20 used in each embodiment can vary within the scope of the invention. Also, the post 22*d* and the guide pins 22*e* of each arm 22 can be fabricated separately and press fitted, or attached in any other known manner, to the arm. It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. The fan assembly comprising:

a rotor end casing having a slot;

a blade having an opening;

an arm comprising:

a body member, a flange formed on the body member and extending in the slot of the casing to mount the arm to the casing, and an externally threaded post extending from the body member and through the opening of the blade;

an internally threaded cap threadedly engaging the post to secure the blade to the arm;

at least one additional blade having an opening;

at least one additional arm comprising:

a body member, a flange formed on the latter body member and extending in the slot of the casing to mount the additional arm to the casing, and an externally threaded post extending from the latter body member and through the opening of the additional blade; and an internally threaded cap threadedly engaging the latter post to secure the additional blade to the additional arm.

2. The assembly of claim 1 wherein the slot is circular and wherein the flange is arcuate and extends in a portion of the slot.

3. The assembly of claim 1 further comprising at least one guide pin on the arm and at least one additional opening in the blade for receiving the guide pin to align the blade relative to the arm.

4. The assembly of claim 1 wherein the slot is circular and wherein the flange of each body member is arcuate and extends in a portion of the slot.

5. The assembly of claim 1 further comprising a housing, and wherein the rotor end casing comprises an upper portion mounted in the housing and a lower portion connected to the upper portion and having a portion protruding from the housing.

6. A method for assembling a fan assembly comprising the steps of placing a fan blade over an arm having an externally threaded post that extends in an opening in the blade, then threading an internally threaded cap over the post to secure the blade to the arm, and inserting a flange on the arm in a slot in the rotor of the fan motor to retain the arm relative to the rotor.

7. The method of claim 1 further comprising the step of guiding the blade relative to the arm during the step of placing.

8. A fan assembly comprising a rotor end casing having an annular slot and at least one axial slot adjacent the annular slot; an arm having a portion extending in the axial slot, a flange extending from the arm and in a portion of the annular slot, and a retaining ring attached to the end casing and having a portion engaging the arm to lock the flange in the annular slot and the arm to the end casing.

9. The assembly of claim 8 wherein the retaining ring engages a portion of the arm extending in the axial slot.

10. The assembly of claim 9 wherein the arm portion is necked-down and extends between the flange and the remaining portion of the arm.

11. The assembly of claim 10 wherein the flange and another portion of the arm engage the end casing to capture the arm portion in the slot.

12. The assembly of claim 10 wherein the arm portion engages the surfaces of the casing defining the axial slot in a friction fit.

13. The assembly of claim 8 wherein the arm portion engages the surfaces of the casing defining the axial slot in a friction fit.

14. The assembly of claim 8 wherein the flange is arcuate and extends substantially perpendicularly to the arm.

15. The assembly of claim 8 wherein the end casing is externally threaded, and the retaining ring is internally threaded and is in threaded engagement with the end casing.

16. The assembly of claim 8 wherein another portion of the arm is relatively wide, and further comprising a blade connected to the latter arm portion.

17. The assembly of claim 16 wherein the weight of the blade establishes a fulcrum that urges the flange into the annular slot.

18. The fan assembly of claim 8 wherein the end casing comprises a first cylindrical member having the axial slots formed therein, and a second cylindrical member disposed in a spaced, coaxial relation to the first cylindrical member so as to define the annular slot.

19. The assembly of claim 18 wherein the second cylindrical member is externally threaded, and wherein the retaining ring is internally threaded and is in threaded engagement with the second cylindrical member.

20. The assembly of claim 8 where there are a plurality of axial slots formed in the end casing and further comprising at least one additional arm having a portion extending in an additional axial slot, a flange extending from the additional arm and in another portion of the annular slot, another portion of the retaining ring engaging the additional arm to lock the latter flange in the annular slot and the additional arm to the end casing.

* * * * *

UNITED STATES PATENT AND TRADEMARK OFFICE

CERTIFICATE OF CORRECTION

PATENT NO. : 6,042,339
DATED : March 28, 2000
INVENTOR(S) : Frank Blateri et al.

It is certified that error appears in the above-identified patent and that said Letters Patent is hereby corrected as shown below:

Column 4,
Line 28, replace "claim 1" with -- claim 6 --

Signed and Sealed this

Fourteenth Day of May, 2002

*Attest:*

*Attesting Officer*

JAMES E. ROGAN
*Director of the United States Patent and Trademark Office*